United States Patent [19]

Reynoir et al.

[11] 4,203,504

[45] May 20, 1980

[54] METHOD AND SYSTEM FOR ESCAPING FROM AN OFFSHORE DRILLING PLATFORM

[75] Inventors: Ronald H. Reynoir; Robert A. Flautt, both of New Orleans, La.; Clyde M. Leavitt, Ocean Springs, Miss.

[73] Assignee: The Reynoir Company, New Orleans, La.

[21] Appl. No.: 951,460

[22] Filed: Oct. 16, 1978

[51] Int. Cl.[2] ..... A62B 1/02; B63C 9/02

[52] U.S. Cl. ..... 182/10; 182/191; 114/293

[58] Field of Search ..... 182/10, 191, 192, 193, 182/5-7; 9/14; 114/293

[56] References Cited

U.S. PATENT DOCUMENTS

| | | | |
|---|---|---|---|
| 284,180 | 9/1883 | Burghardt | 182/47 |
| 807,802 | 12/1905 | Auld | 9/14 |
| 1,120,866 | 12/1914 | Tracy | 9/14 |
| 1,556,555 | 10/1925 | Brown | 9/14 |
| 3,552,343 | 1/1971 | Scott | 114/293 |
| 3,826,335 | 7/1974 | Allen | 182/10 |
| 4,056,167 | 11/1977 | Bonafos | 182/10 |
| 4,122,917 | 10/1978 | Kendrick | 182/10 |

*Primary Examiner*—Reinaldo P. Machado
*Attorney, Agent, or Firm*—Cushman, Darby & Cushman

[57] ABSTRACT

Improved method and system for escaping from an offshore drilling or production platform in an emergency situation. A stable buoyant structure is floated and anchored in a fixed position nearby but at a safe distance from the platform. The structure is constructed to form a safe haven and is connected to the platform by an aerial cableway along which a personnel carrier is movable in either direction. Preferably the haven is in the form of a self-propelled vessel provided with a helicopter platform.

32 Claims, 9 Drawing Figures

METHOD AND SYSTEM FOR ESCAPING FROM AN OFFSHORE DRILLING PLATFORM

TECHNICAL FIELD

This invention relates to an improved method and apparatus for use in escaping or evacuating personnel from offshore structures, such as drilling or production platforms located over water, in emergency situations. More especially, it relates to an improved method and apparatus which permits rapid, safe escape to a floating haven located at a safe distance from the endangered platform.

BACKGROUND ART

Unfortunately, offshore drilling rigs or platforms, both mobile and fixed, and offshore production platforms located at a considerable distance from land, are subject to explosions and fires. Fortunately such events are infrequent, but when they occur, as they sometimes do, they create a situation of tremendous emergency. Immediate, fast and safe evacuation of personnel is essential to preserve life and limb.

Present arrangements for such evacuation include inflatable or rigid life rafts or other types of escape craft, both powered and unpowered, which must be launched into the sea. The launching of such escape craft not only is somewhat time consuming but also is itself fraught with danger because of both the hazardous condition on the platform itself, e.g. burning oil or gas, and also on occasion hazardous high seas. Under such launching circumstances it is even possible for the escape craft to become entangled with the platform, thus rendering escape almost impossible. Further, the seas sometimes may be covered with a layer of burning oil. The launching of an escape craft into such a hazardous situation, or even drifting thereinto after being launched, is fraught with even greater peril.

Arrangements for avoiding some of the aforementioned difficulties of launching escape craft are disclosed in U.S. Pat. Nos. 3,796,281 and 3,880,254. In both of those arrangements, however, the escape craft eventually is launched directly into the sea which itself may present a dangerous situation.

Arrangements have been devised for escaping from land-based drilling derricks in case of emergency, such as, for example, the cableway arrangement disclosed in U.S. Pat. No. 2,670,890. For an offshore drilling platform, however, such an arrangement is no more practical than the arrangements disclosed in the first two above-mentioned patents, because, again, escape would be into the sea.

Of course, it is known to transfer personnel from one vessel to another while at sea by cableway arrangements, for example such as that shown in U.S. Pat. No. 1,120,866. In such arrangements, however, at least one, and usually both of the vessels are underway or at least maneuverable and not anchored so that they are not maintained at a fixed distance apart. Moreover, the vessels usually are moving up and down because of wave action. As a result, personnel being transferred from one vessel to another by such an arrangement frequently undergo a "dunking". This would be extremely hazardous if the sea was very rough or covered by a layer of burning oil. Although said U.S. Pat. No. 1,120,866 discloses a counterbalance arrangement for automatically tensioning the cableway to prevent undue sagging thereof, such transfer arrangements are only temporary and usually installed under trying circumstances, as when one of the vessels is in distress because of a storm.

DISCLOSURE OF INVENTION

Accordingly, it is an object of this invention to provide an improved method and system for quickly and safely evacuating personnel, in an emergency situation, from an offshore platform, which may be of the drilling or production type, to a safe, stable haven located at a sufficient distance from the endangered platform so as to be substantially unaffected by the hazardous conditions thereon which necessitated evacuation and having the capacity to accommodate all personnel evacuated from the platform.

It is another object of this invention to provide such a method and system which does not involve the launching of escape craft into the sea so that evacuated personnel are not subject to the hazards of high seas or oil burning thereon.

It is another object of this invention to provide such a method and system wherein personnel are evacuated by aerial transfer to the haven.

It is another object of this invention to provide such a method and system wherein the haven provides a safe place from which personnel can be evacuated by helicopter, and/or wherein the haven itself is self-propelled and movable away from the endangered platform after all personnel have been evacuated to the haven.

The foregoing is accomplished by the provision of a buoyant floating structure forming a haven secured by anchors relatively near but at a safe distance from an offshore platform with an aerial cableway extending therebetween. Personnel carriers are movable along the cableway for the evacuation of personnel from the platform to the haven, preferably by controlled gravity descent.

Other objects and advantages of the invention will become apparent from the following description and drawings in which:

BEST MODE FOR CARRYING OUT THE INVENTION

Figure 1:
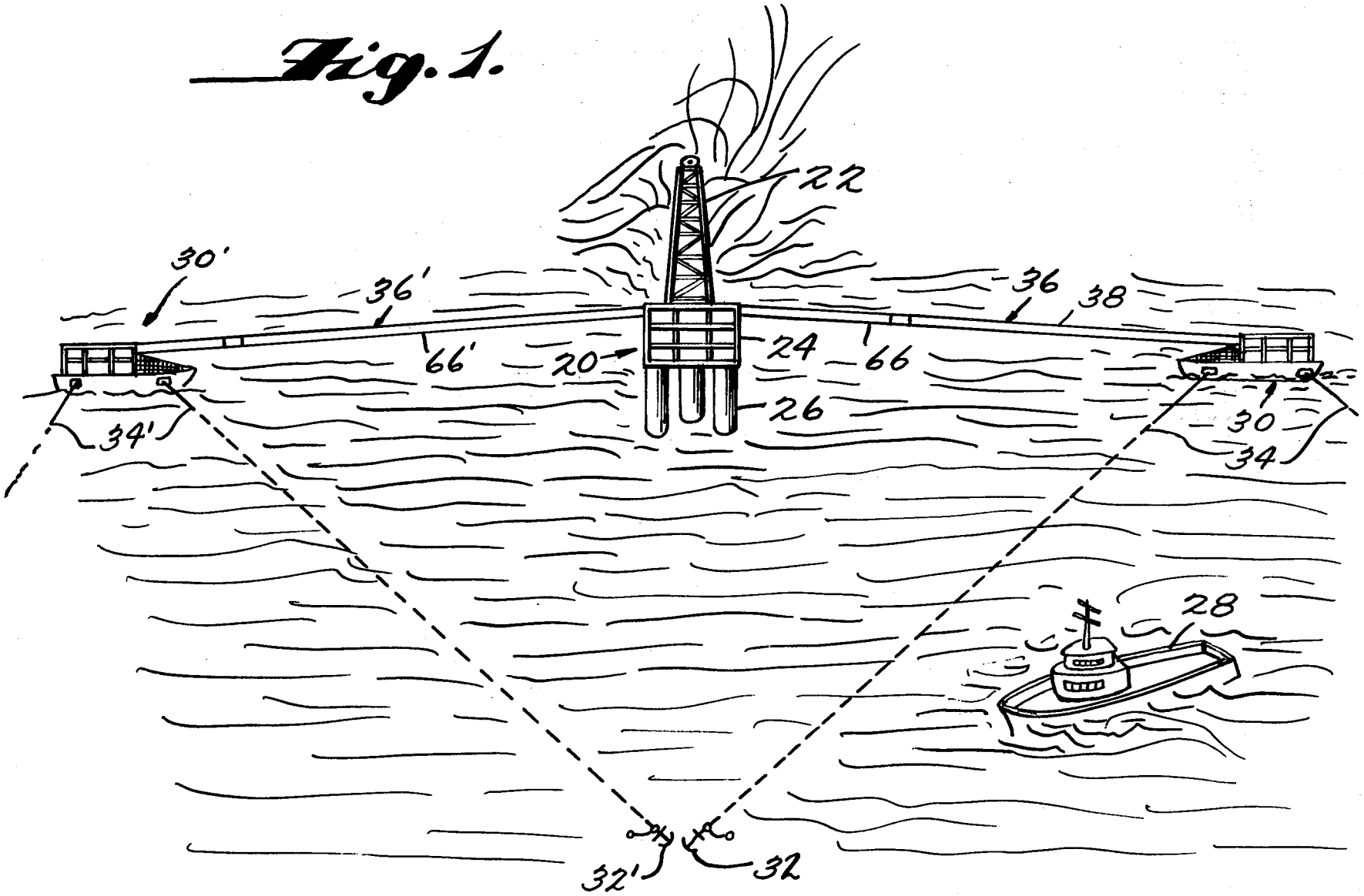
FIG. 1 is a perspective view of a burning offshore drilling platform showing personnel being evacuated therefrom to a nearby safe haven in accordance with this invention.
Figure 2:
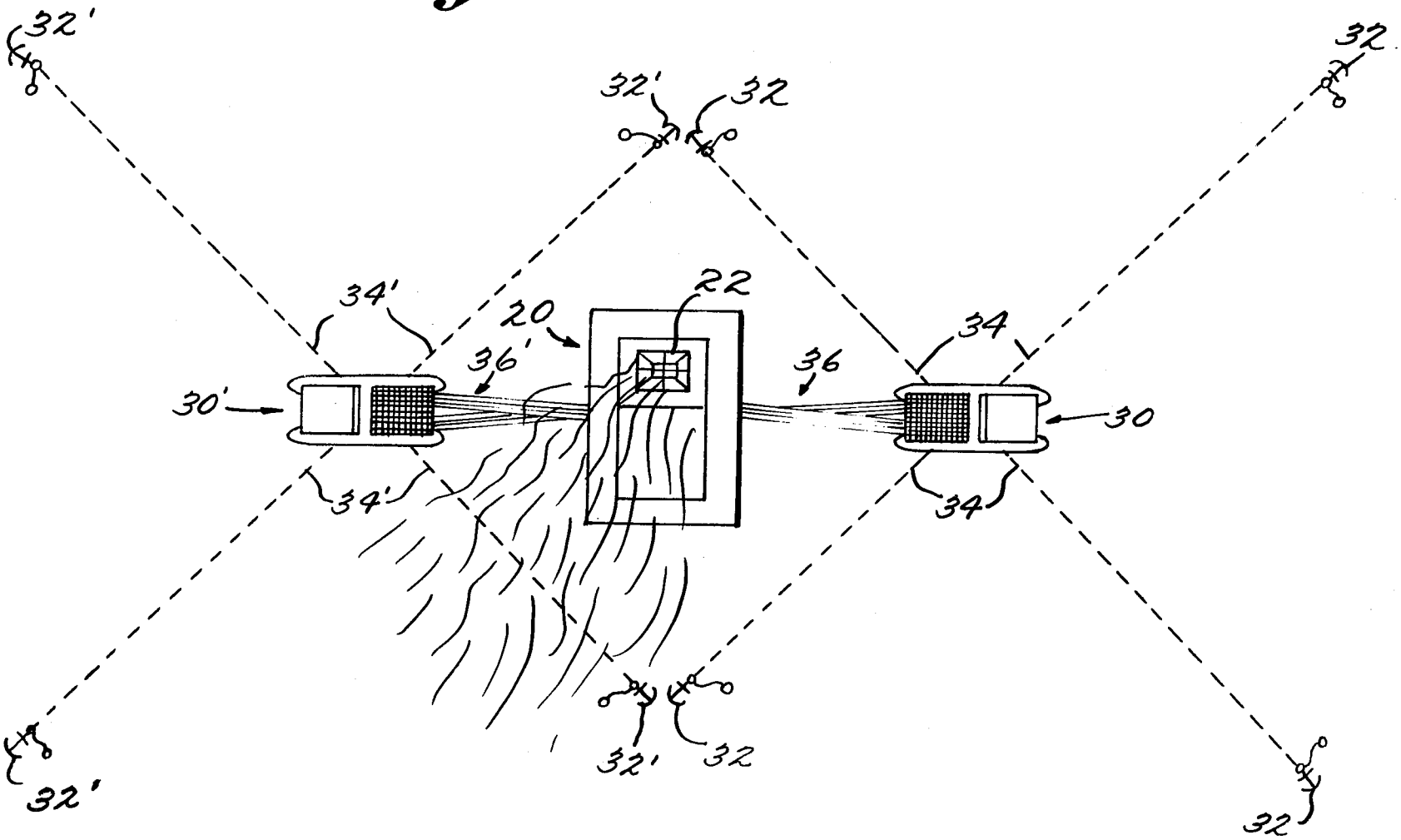
FIG. 2 is a plan view of the offshore platform and evacuation system shown in FIG. 1.
Figure 3:
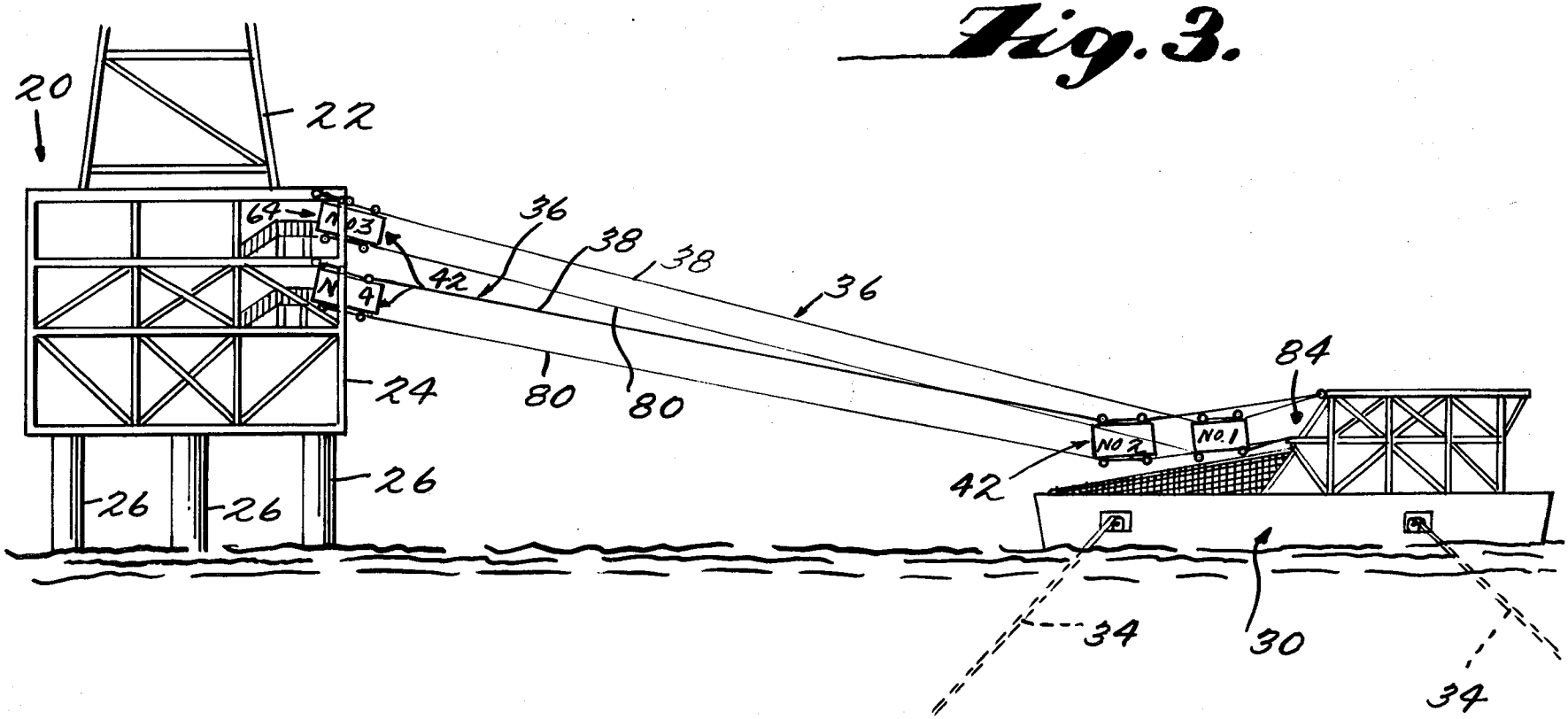
FIG. 3 is an enlarged fragmentary elevational view of a portion of the evacuation system shown in FIG. 1 prior to the fire.

Referring now to the drawings there is shown in FIGS. 1, 2 and 3 the basic concept of this invention for quickly and safely evacuating personnel from an offshore platform 20 on which a hazardous condition has suddenly occurred. The platform 20 is illustrated as being of the drilling rig type having a drilling derrick 22 carried on a superstructure 24 on top of supporting legs 26. The platform 20 may be of the fixed type or any of the well known mobile types, i.e. jack-up, semisubmersible and drill-ship. If mobile, the platform 20, when in operative position for drilling, still will be substantially fixed relative to the marine bottom. FIGS. 1 and 2 of the drawings illustrate the rig 20 as being on fire and the seas as running high as shown, for example, by the pitching workboat 28. Located nearby but at a safe distance away from the burning platform 20, is a stable buoyant floating haven 30 previously fixed in position by a plurality of anchors 32 spaced thereabout. Four such anchors 32 and corresponding anchor cables 34 for the haven 30, and anchors 32' and cables 34' for the haven 30', are shown in FIGS. 1 and 2, although it will be realized that any appropriate number of such anchors may be used.

It also is desirable, although not essential, that two such havens 30 and 30' be used for, and on opposite sides of, the offshore platform 20, as shown in FIGS. 1 and 2, and that they be positioned relative to the platform in an advantageous location with respect to prevailing winds, tides and marine traffic.

Figure 4:
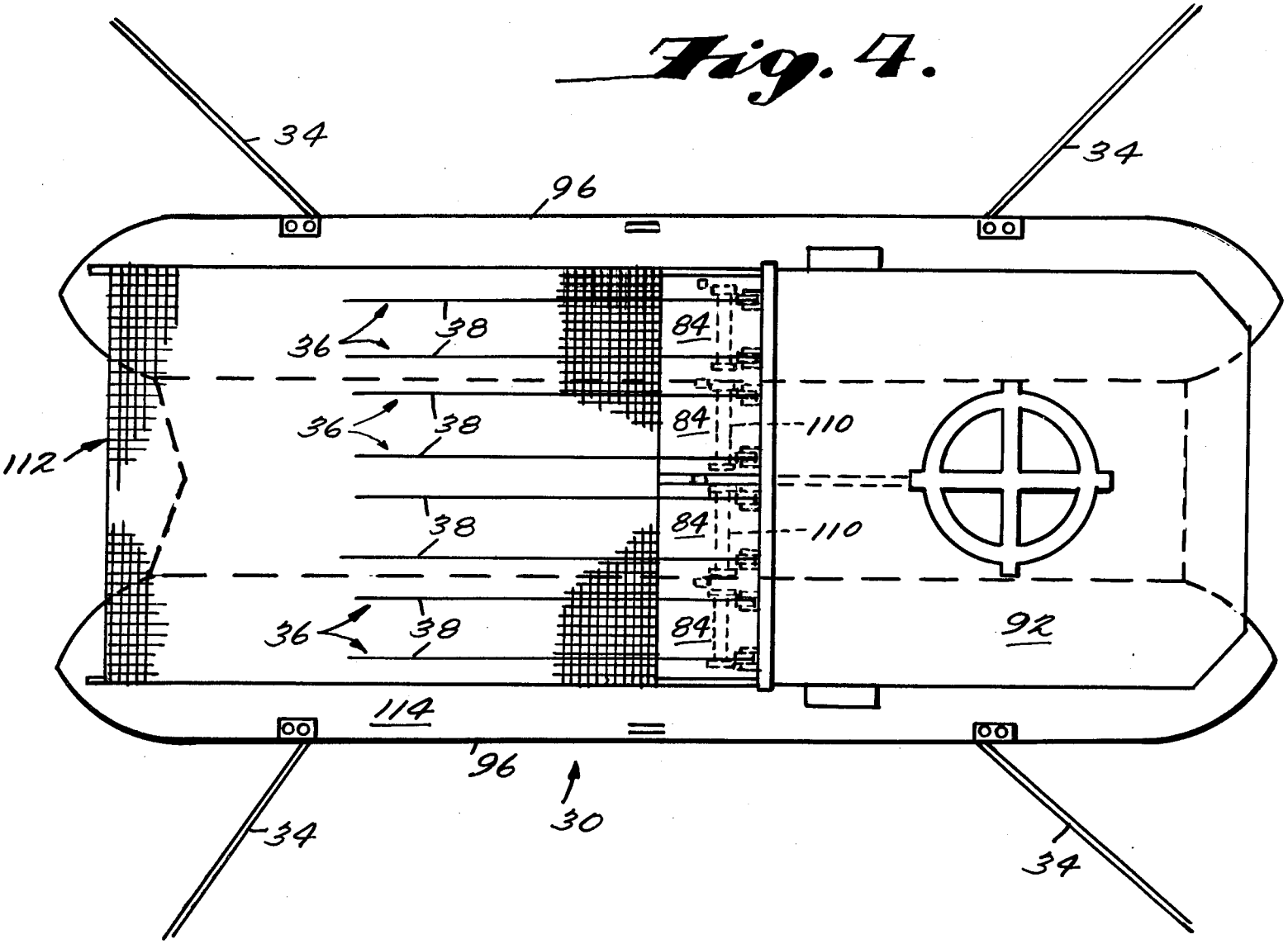
FIG. 4 is an enlarged plan view of the haven shown in FIG. 3.

Connected to and extending between each haven 30 and 30' and the platform 20 are cableways 36 and 36'. Although the cableways 36 and 36' comprise only one cable, for maximum stability they preferably are in the form of two parallel horizontally spaced cables 38, as shown best in FIG. 4 of the drawings. For reasons later explained it is preferable that more than one cableway 36 and 36' extend between each haven 30 and 30' and the platform 20, as illustrated in the drawings, but a description of the cableway 36 with reference to the haven 30 will suffice for all. One end of each cableway 36 is fixedly secured to the platform superstructure 24 at an elevation higher than that at which the other cableway end is attached to the haven 30 so that the cableway will be inclined downwardly from the platform 20 toward the haven, the angle of inclination being preferably of the order of about 5–6 feet in each 100 feet. Each haven 30 and 30' is moored at a safe distance, e.g. from about 250 to 300 feet, from the platform so that hazardous conditions, e.g. a fire or explosion, on the latter will have substantially no adverse effects upon the havens, while at the same time the cableways 36 and 36' can extend completely above water between the platform and the havens with no intermediate support.

Figure 7:
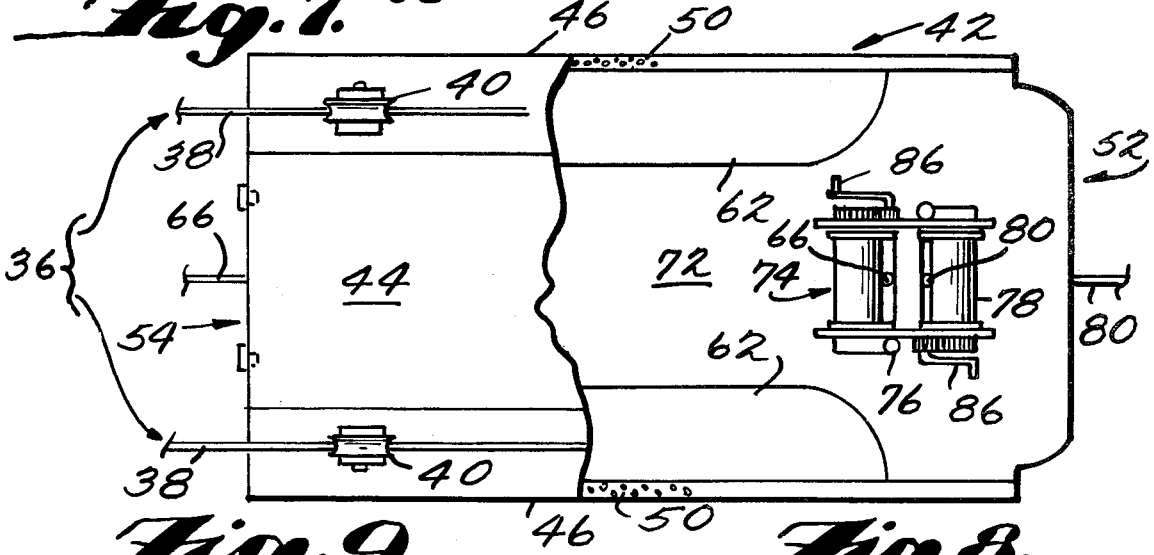
FIG. 7 is a plan view, partly in horizontal section, of the carrier shown in FIG. 7.
Figure 9:
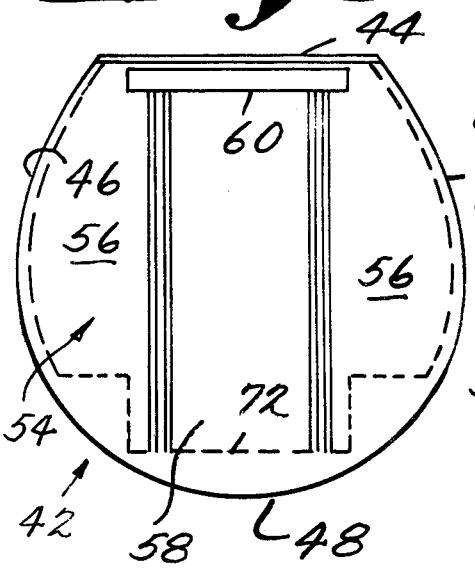
FIG. 9 is a view of the platform-facing end of the carrier shown in FIG. 6. Certain parts are omitted for simplicity of illustration.
Figure 8:
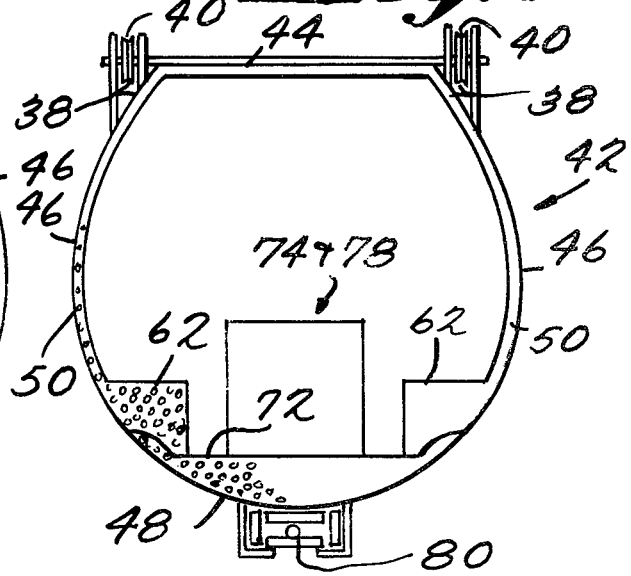
FIG. 8 is a view, in vertical section, of the haven-facing end of the carrier shown in FIG. 6.

Movable along the cableway 36 and suspended therefrom by four sheaves 40, one at each top corner, is a personnel carrier 42 in the form of an elongated car having, in cross-section, a flat top 44 and convexly curved sides 46 and a bottom 48. While it is to be understood that the carrier 42 could be suspended from a cableway comprising a single cable by only two sheaves, spaced longitudinally along the center line of the carrier, a two-cable cableway 36 and four carrier-suspending sheaves 40, as shown, are preferred to minimize rocking or swaying of the carrier 42 and make for overall increased stability. The carrier 42 preferably has a skeletal lightweight frame (not shown), of steel or the like with the top 44, sides 46 and bottom 48 being of double wall construction, as shown in FIGS. 7–9, formed of some strong lightweight metallic or synthetic material. The space within such double walls is filled with cellular or other form of floatation material 50 so that in the event of an accident, and the carrier 42 should fall into the sea, it will be sufficiently buoyant to float. The haven-facing end 52 of the carrier 42 may be open but its top 46, sides, and bottom 48 and platform-facing end 54 (shown in FIG. 9) are provided with heat and fire resistant shielding (not shown). On the top 44, sides 46 and bottom 48 of the carrier 42 such shielding may be in the form of exterior aluminized asbestos cloth. On the platform-facing end 54 of the carrier 42 the shielding may be provided by aluminized asbestos paneling 56 having an opening therethrough forming an entranceway 58 for personnel. As best shown in FIG. 9 of the drawings, the entranceway 58 may be selectively covered and uncovered by a pull-down type of flexible fire and heat resistant shielding 60 normally rolled up across the top of the entranceway. Arranged within and along opposite sides of the carrier 42 may be benches 62 for seating personnel.

Secured to the platform 20 adjacent the carrier station 64 thereon is one end of an in-haul cable 66 which passes through a guide roller 68 beneath the carrier 42 adjacent its platform-facing end 54, around a guide sheave 70 adjacent the haven-facing end 52 of the carrier, and thence upwardly through an opening in the floor 72 of the carrier where the other end is attached to an in-haul winch 74 supported on the floor. The winch 74 is provided with a hand brake 76, as illustrated in FIG. 7. Adjacent the in-haul winch 74 is an out-haul winch 78 of similar design having one end of an out-haul cable 80 secured thereto. The cable 80 passes downwardly through an opening in the floor 72 of the car 42, around a guiding sheave 82, and thence to the haven carrier station 84 where the other end of the out-haul cable is securely attached. While both winches 74 and 78 have been shown as being operated by hand cranks 86, provision may be made, as desired, for power operation, such as by a small internal combustion engine, battery-operated electric motors, or the like (not shown).

Figure 5:
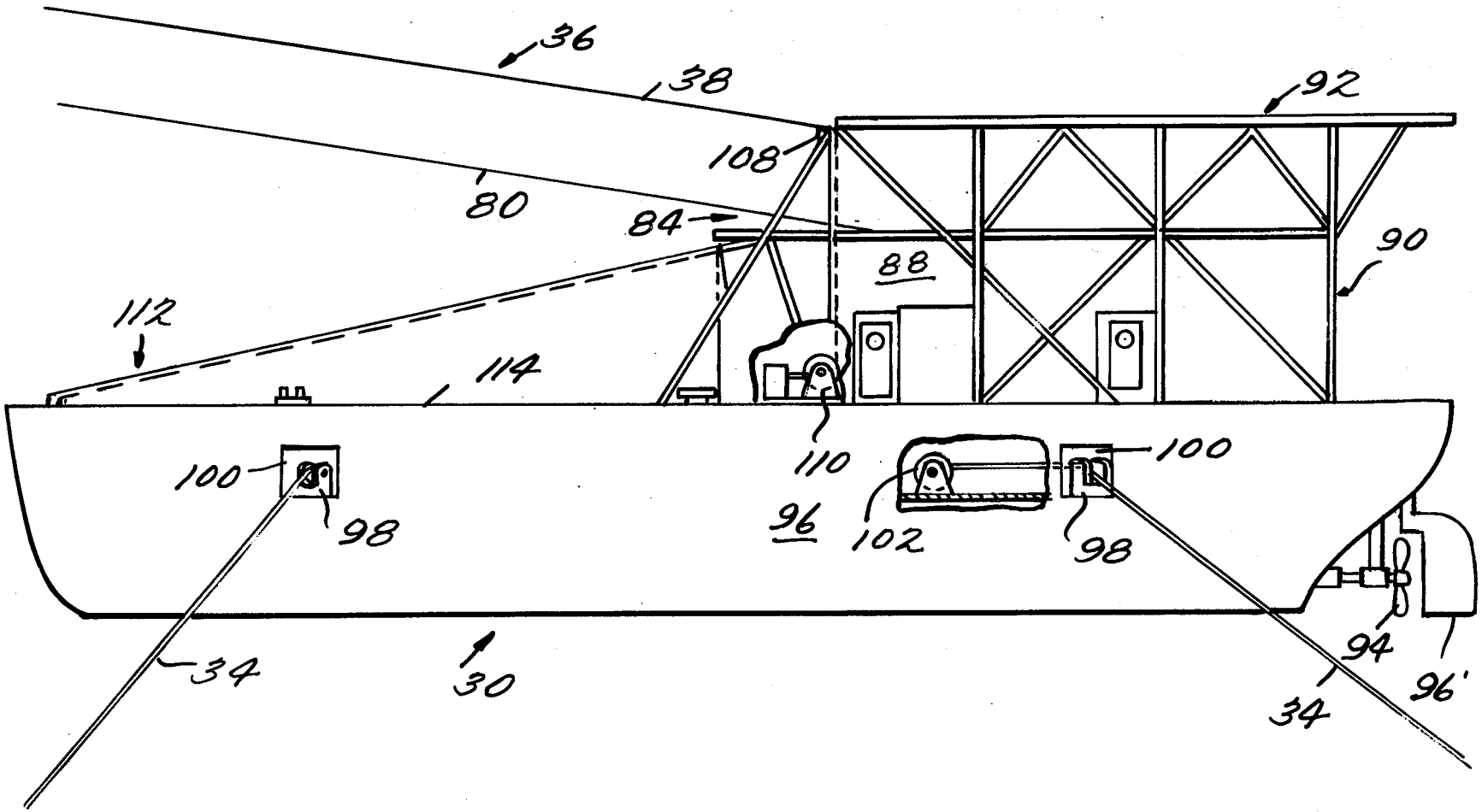
FIG. 5 is an enlarged side elevational view with portions broken away to show interior details of the haven shown in FIG. 4.
Figure 6:
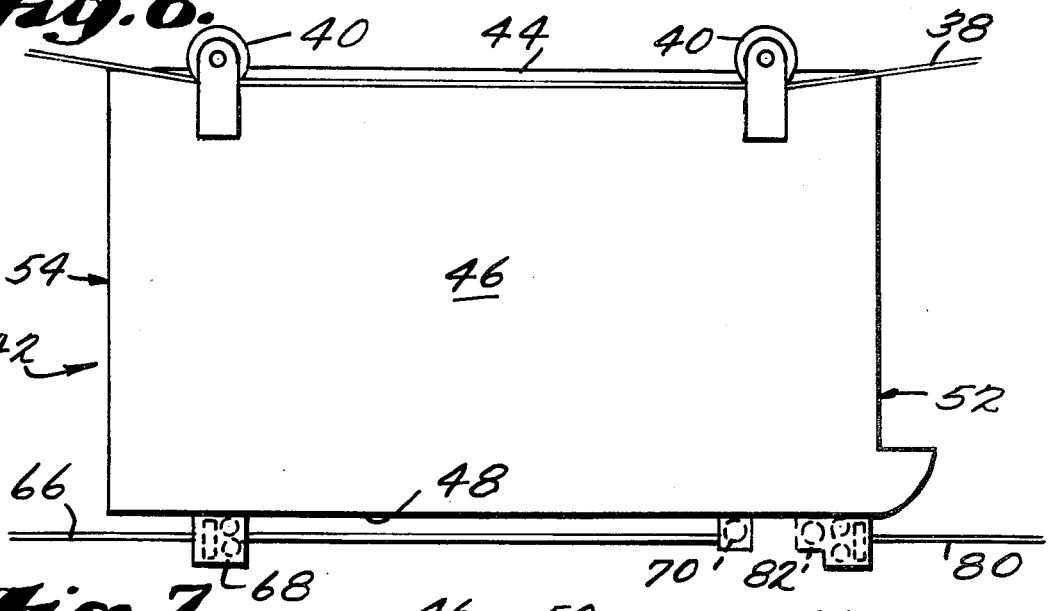
FIG. 6 is a side elevational view of one of the personnel carriers shown in FIG. 3.

For obvious reasons the havens 30 and 30' should be as stable as possible in rough seas and large enough to provide sufficient support for the outboard end of the cableways 36. A structure of the semisubmersible type, such as a ballastable spar design, would fulfill such a requirement. A catamaran type vessel, however, as shown in the drawings, not only fulfills the maximum stability requirement but also can be more readily and conveniently self-propelled. Further, a haven of the self-propelled vessel type eliminates the necessity of ballasting and deballasting a semisubmersible structure. It will be realized, however, that other designs are possible so long as the haven is relatively stable and can be suitably anchored in position. As shown, the catamaran haven 30 has a deckhouse 88 on its aft portion and supported thereabove by a suitable truss structure 90 is a helicopter landing pad or platform 92 for rapid evacuation or transfer of personnel from the haven to shore. Preferably, the haven is provided with a first aid station (not shown) which may be located in the deckhouse 88 or below. It also is desirable that the catamaran haven 30 be self-propelled, as by a propeller 94 located at the aft end of each of the pontoons 96 of the catamaran and driven by a suitable propulsion motor (not shown) within the pontoon. Aft of each propeller is the usual steering rudder 96'. Each of the anchor cables 34, one located fore and one aft in the outer side of each pontoon 96, passes through a suitable fairlead 98 located in a recess 100 in the outer side of a pontoon 96. In order to maintain the catamaran 30 in as fixed a position as possible in rough seas each anchor cable 34 is engaged by an automatic device as is known in the art, such as a tensioning winch 102 as shown in FIG. 5, to substantially maintain a predetermined tension on the cable.

The haven station or landing deck 84 for the personnel carriers 42 is located just forward of the helicopter pad 92 on top of the deckhouse 88. In order to have sufficient capacity for rapid evacuation of all of the personnel on the platform 20, it is desirable that more than one cableway 36 be provided so that the carriers 42 may be of a practical size. Four such cableways 36 are illustrated in the drawings so that the haven carrier station or landing deck 84 extends athwartship and is adapted to accommodate four carriers 42 simultaneously. For convenience, the cableways 36, carriers 42 and their stations 64 and 84, may be numbered 1, 2, 3 and 4 from left to right facing the haven station 84 from the bow of the catamaran 30. The cables 38 for each cableway 36 pass over sheaves 108 supported on the trusswork 90 at the forward end of the helicopter pad 92 and thence downwardly to tensioning winches 110, there being one such winch for each cableway. Forward of the carrier station 84 the haven 30 is provided with a safety net 112 which substantially overlies the forward portion of the weather deck 114 lying beneath the path of the carriers 42.

On the platform 20 the carrier stations 64 preferably are arranged on two levels, Nos. 1 and 3 just below the top of the superstructure 24 and Nos. 2 and 4 immediately below Nos. 1 and 3. With this arrangement the cables 34 of the upper cableways Nos. 1 and 3 cross the cables of the lower Nos. 2 and 4 only adjacent the platform 20, and there with sufficient vertical clearance to avoid any interference between upper and lower carriers 42. Preferably, suitable latching mechanism (not shown) is provided at each platform station 64 to secure each carrier 42 in loading position, as shown in FIG. 3 of the drawings.

Under normal conditions all of the personnel carriers 42 are in loading position at the platform stations Nos. 1–4 and secured in position by the latching mechanism. In the event of emergency conditions arising, however, which require rapid, safe evacuation of personnel, the carriers 42 are loaded as quickly as possible, the latching mechanism disconnected, and the carriers allowed to descend by gravity, under control of the in-haul winch brake 76, to the haven 30. During this procedure the out-haul winch 78 is operated to wind up the out-haul cable 80. As each carrier 42 approaches its haven station 84 its cableway 36 probably will sag so that the carrier is slightly below its haven station as shown in FIG. 3. In that event operation of the out-haul winch 78 will be necessary to move the carrier 42 to its haven station 84. In the event of any difficulty, however, which prevents the carrier 42 from reaching its haven station 84, the personnel aboard can reach the safety net 112 and move aft therealong to the after portion of the weather deck 114. Manifestly, the cables 38 of each cableway 36, and also the in-haul and out-haul cables 66 and 80, are made of fire and heat resistant metal so as to minimize the danger of their burning away or otherwise becoming detached from the platform 20 in the event of a fire thereon. As a further precaution, however, in the event of such occurrence, the carriers 42 are sufficiently buoyant, as aforedescribed, to float in the event they fall into the sea and their out-haul winches 78 can still be operated to pull the carrier to the haven 30. Still further, the sheaves 40 of each carrier 42 may be fastened to the latter by quickly detachable or disconnectable means (not shown) so that in the event of a situation which requires a carrier to be freed from its cableway 36, such can be quickly accomplished.

In order to install the escape system, once the platform 20 is in operative position, the following procedure may be utilized. The carriers 42 are loaded onto the haven 30 and appropriately secured at their stations 84 thereon with the in-haul and out-haul cables 66 and 80 attached to and wound up on the in-haul and out-haul winches 74 and 78, respectively. The free end of the out-haul cable 80 wound up on each out-haul winch 78 can then be appropriately secured to the haven 30 at the carrier station 84. The cableways 36 similarly are loaded onto the haven 30 and wound up on their tensioning winches 110, while outer portions of their free ends may be appropriately threaded through the carrier sheaves 40. The haven 30 then may be maneuvered bow on under its own power to a position closely adjacent the platform 20 where it is maintained in position, by the cables 34 and anchors 32 if necessary, while lines (not shown) are dropped from the platform to pull up the free ends of the cableways 36 and of the in-haul cables 66 for attachment in their operative positions to the platform. The haven 30 then may be backed under its own power, while paying out the in-haul cables 66 and cableways 36, to its own operative position near but at a safe distance from the platform 20. Its anchors 32 and cables 34 are then appropriately extended and engaged with the marine bottom, as by appropriate maneuvering of the haven 30 itself under power, or by small boats (not shown) as is well known in the nautical world. The anchor cables 34 are then tightened by their winches 102 and appropriately tensioned. Thereupon the cableway tensioning winches 110 may be operated to appropriately tension the cableways 36 so that they are maintained above water with the minimum practical sag therein.

Preferably, the in-haul cables 62 are arranged to be quickly unwound and disconnected from the in-haul winches 74, and also the cableways 36 are arranged so as to be quickly unwound and disconnected from their tensioning winches 110 so that in an emergency, after all personnel have been evacuated from an endangered platform 20, the in-haul cables and cableways can be quickly unwound and so disconnected, the anchors 32 pulled in, and the haven 30 moved under power away from the platform 20.

It thus will be seen that the objects of this invention have been fully and effectively accomplished. It will be realized, however, that the specific embodiment shown and described is susceptible to modification without departure from the principles of the invention. Hence, the invention encompasses all modifications within the spirit and scope of the following claims.

We claim:

1. Apparatus for escaping from an offshore drilling or production platform, or the like, in emergency situations comprising:

an offshore platform in operative position substantially fixed relative to the marine bottom at an offshore location for engaging in hazardous operations involving combustible and explosive fluids entrapped in said bottom;

a buoyant floating haven positioned near but at a safe distance from said platform;

a plurality of anchors arranged about said haven and engaged with the marine bottom;

cables attached to said anchors and to said haven for maintaining the latter in its said position;

a cableway unsupported between its ends attached to and extending above water between said haven and said platform; and a personnel carrier suspended from and movable along said cableway for transferring personnel from said platform to said haven.

2. The apparatus defined in claim 1 including automatic means on the haven for substantially maintaining a predetermined tension in the anchor cables to maintain said haven in a substantially fixed position relative to the platform.

3. The apparatus defined in claim 1 in which the attachment of the cableway to the haven includes winch means for tensioning said cableway.

4. The apparatus defined in claim 1 in which the haven is positioned relative to the platform in the most advantageous location with respect to prevailing winds, tides, and marine traffic.

5. The apparatus defined in claim 1 in which the haven is a self-propelled vessel.

6. The apparatus defined in claim 5 in which the vessel is a catamaran.

7. The apparatus defined in claim 5 in which the vessel is positioned lengthwise of the cableway.

8. The apparatus defined in claim 7 in which the attachment of the cableway to the vessel is intermediate the length thereof, and including a safety net on the vessel extending along and beneath that portion of said cableway and that portion of the path of the carrier which extends over said vessel.

9. The apparatus defined in claim 1 in which the haven has a helicopter platform.

10. The apparatus defined in claim 1 in which the cableway is inclined downwardly from the platform for gravity descent of the carrier from said platform to the haven.

11. The apparatus defined in claim 10 including brake means associated with the carrier for controlling its descent on the cableway.

12. The apparatus defined in claim 1 including in-haul and out-haul cables attached to the platform and to the haven, respectively, and winch means mounted to the carrier for selectively winding up or releasing each of said haul cables to move said carrier in either direction along the cableway.

13. The apparatus defined in claim 1 in which the carrier is buoyant.

14. The apparatus defined in claim 1 in which the top, sides and platform-facing end of the carrier are provided with fire and heat-resistant shielding.

15. The apparatus defined in claim 14 in which the platform-facing end of the carrier is provided with an entranceway and the shielding includes a movable portion for selectively covering or uncovering said entranceway.

16. Apparatus for use in escaping from an offshore drilling or production platform or the like in emergency situations while such platform is in an operative position substantially fixed relative to the marine bottom at an offshore location for engaging in hazardous operations involving combustible and explosive fluids entrapped in said bottom comprising:

a buoyant haven adapted to be floated in a position near but at a safe distance from the offshore platform;

a plurality of anchoring means attached to and arranged about said haven and adapted to be engaged with the marine bottom to maintain said haven in a substantially fixed position while afloat;

a cableway having one end thereof adapted to be attached to said haven and the other to the platform for extending above water therebetween with no intermediate support; and a personnel carrier adapted to be suspended from and to be movable along said cableway when the latter is operatively attached to said haven and to a platform.

17. The apparatus defined in claim 16 in which the anchoring means includes anchor cables and including automatic means on the haven for substantially maintaining a predetermined tension in said anchor cables when said anchoring means is engaged with the marine bottom to maintain said haven in a substantially fixed position relative to the platform.

18. The apparatus defined in claim 16 including cableway-tensioning winch means carried by the haven and adapted to have the one end of the cableway attached thereto.

19. The apparatus defined in claim 16 in which the haven is a self-propelled vessel.

20. The apparatus defined in claim 19 in which the vessel is a catamaran.

21. The apparatus defined in claim 16 in which the haven has a helicopter platform.

22. The apparatus defined in claim 16 including in-haul and out-haul cables adapted to be attached to the platform and to the haven, respectively, and winch means mounted to the carrier for selectively winding up and releasing each of said haul cables to move said carrier in either direction along the cableway.

23. The apparatus defined in claim 16 in which the carrier is buoyant.

24. The apparatus defined in claim 16 in which the top, sides and platform-facing end of the carrier are provided with fire and heat-resistant shielding.

25. The method of providing for the rapid safe escape of personnel from an offshore drilling or production platform, or the like, in emergency situations while such platform is in operative position in substantially fixed relation to the marine bottom at an offshore location for engaging in hazardous operations involving combustible and explosive fluids entrapped in said bottom, the steps comprising:

providing a buoyant haven for accommodating a large portion of the personnel from the platform;

floating the haven at an offshore location near but at a safe distance from the platform;

anchoring the haven at the offshore location in substantially fixed position relative to the platform;

installing an aerial cableway extending above water without intermediate support to and between the platform and the haven; and suspending a personnel carrier from and movable along the cableway to transport personnel from the platform to the haven.

26. The method defined in claim 25 wherein the cableway is installed so that its platform end is higher than its haven end for gravity descent of the carrier from the platform to the haven.

27. The method defined in claim 25 in which the haven is in the form of a vessel.

28. The method defined in claim 27 in which the vessel is self-propelled.

29. The method defined in claim 28 in which the vessel is a catamaran.

30. The method defined in claim 25 in which the carrier is provided with in-haul winch means and out-haul winch means and including the steps of installing an in-haul cable having one end attached to the platform and the other to the in-haul winch means and installing an out-haul cable having one end attached to the haven and the other to the out-haul winch means.

31. The method defined in claim 25 in which the carrier is buoyant.

32. The method defined in claim 25 in which the top, sides and platform-facing end of the carrier are provided with fire and heat-resistant shielding.

* * * * *